US005752842A

United States Patent [19]

Friederichs et al.

[11] Patent Number: 5,752,842

[45] Date of Patent: May 19, 1998

[54] PUSH-IN/PUSH-OUT LAMPHOLDER

[75] Inventors: Winand H.A.M. Friederichs, Bath, N.Y.; Hans Wedding, Arnsberg, Germany

[73] Assignee: U.S. Philips Corporation, New York, N.Y.

[21] Appl. No.: 749,445

[22] Filed: Nov. 15, 1996

[30] Foreign Application Priority Data

Nov. 16, 1995 [EP] European Pat. Off. ..... 95203138
Dec. 11, 1995 [EP] European Pat. Off. ..... 95203446

[51] Int. Cl.[6] ..... H01R 13/62
[52] U.S. Cl. ..... 439/152; 439/356
[58] Field of Search ..... 439/152, 356, 439/611–616

[56] References Cited

U.S. PATENT DOCUMENTS 4,565,944 1/1986 Beurskens et al. ..... 439/616
5,207,600 5/1993 Van Dulmen ..... 439/356

*Primary Examiner*—Khiem Nguyen
*Assistant Examiner*—Eugene G. Byrd
*Attorney, Agent, or Firm*—Walter M. Egbert, III

[57] ABSTRACT

The push-in/push-out lampholder has a guide track for an unlocking member which is permanently coupled to a fixation member. The guide track may be heart-shaped and be partly traversed by the unlocking member when a lamp cap is pressed into the lampholder. The lamp cap must be released if it is to reach an operational position under the influence of a spring. The fixation member permanently coupled to the unlocking member is then in engagement with a profile of the lamp cap and retains the lamp, pressed against contact members. It is not until a second, separate push is given that the unlocking member continues its path through the guide track. In a special embodiment, the fixation member and the unlocking member are combined into an integrated member, which may be a ball which is enclosed in inwardly narrowing bores of a cylindrical ball holder and in the guide track. The lampholder can be slim and can be manufactured mainly from metal or from synthetic resin.

15 Claims, 7 Drawing Sheets

PUSH-IN/PUSH-OUT LAMPHOLDER

BACKGROUND OF THE INVENTION

The invention relates to a push-in/push-out lampholder comprising:

a housing having an axis, a wall around said axis, a base transverse to said axis and connected to said wall, and an insertion opening for a lamp cap of an electric lamp opposite said base;

a first and a second axially movable contact member in said housing, facing towards said insertion opening so as to make contact with contacts of said lamp cap, the first being centrally placed and the second being situated on a circle which is concentric with the first contact member;

a radially movable fixation member with a gripping portion in the housing for gripping into a profile of said lamp cap with locking action and retaining the lamp cap;

an unlocking member in the housing which is axially movable against a spring pressure directed towards the insertion opening and which serves to unlock the fixation member from the profile of the lamp cap, which unlocking member is coupled to the fixation member.

Such a push-in/push-out lampholder is known from U.S. Pat. No. 5,282,756, as is a capped electric lamp designed for this lampholder, the lamp cap thereof having a circumferential groove in its shell.

An electric lamp with a lamp cap suitable for use in a push-in/push-out lampholder is also described in a Patent Application of earlier date EP 95 202 908.0 (PHN 15.519).

A push-in/push-out lampholder is attractive because the lampholder can be used in a luminaire which is so narrow that it can just accommodate a lamp and accordingly offers no space for fingers to grip around the lamp when the lamp is inserted or removed. Such a lampholder is also attractive because of the ease with which a lamp is placed: the lamp can be inserted into the holder in a simple translatory movement in any rotational position, and because of the ease with which the lamp is removed again: by pushing against it once more.

When a lamp is placed in the known lampholder, the fixation member slides along the lamp cap until the lamp cap has been brought so far into the lampholder that the fixation member starts engaging the profile in the lamp cap. The lamp cap contacts are in contact with the contact members of the lampholder then to allow burning. The second contact member is at the same time the unlocking member here.

The lamp cap is initially pressed deeper into the lampholder when the lamp is removed from the lampholder. The unlocking member is pressed farther into a mechanism thereby, pulling at the fixation member via springs. The fixation member, which is fastened to a rocker arrangement with two pivot points, is pivoted away thereby and releases the lamp cap.

The known push-in/push-out lampholder has the important disadvantage that it is possible during insertion of a lamp into the lampholder to press the lamp so far, in one movement, that the lampholder releases the lamp again. This is a disadvantage especially where the lamp is operated in the base-up position because the lamp can drop then and break.

Another disadvantage of the known push-in/push-out lampholder is that the unlocking member is live and the mechanism as a whole is under electric tension. The result of this is that the lampholder must be made from an insulating material. A further disadvantage of the lampholder is that it is very voluminous and substantially has the same width as the lamp to be accommodated.

Furthermore, it is a disadvantage of the known lampholder that the mechanism inside the holder with its pivot points is unreliable. High operating temperatures, partly caused by the passage of current, and the risk of corrosion may cause the mechanism to become blocked, so that an accommodated lamp can no longer be removed.

SUMMARY OF THE INVENTION

It is an object of the invention to provide a push-in/push-out lampholder of the kind described in the opening paragraph which is of a reliable construction, which requires a second, separate push against the lamp for removing it from the holder, and whose fixation member and unlocking member are free from electric tension during operation of an accommodated lamp.

According to the invention, this object is achieved in that the lampholder comprises a guide track for the unlocking member with:

(i) a first rest position comparatively close to the insertion opening;

(ii) a first path to a second rest position, which first path extends first in axial direction to beyond the second rest position and subsequently leads to the second rest position;

(iii) a second path extending from the second rest position, initially moving away axially from the first rest position and subsequently approaching the first rest position, in which first rest position the unlocking member keeps the fixation member in an unlocking position, and in which second rest position the unlocking member keeps the fixation member, which is capable of engagement in said lamp cap then, in a locking position, the fixation member is permanently, non-elastically coupled to the unlocking member and is axially movable together with the unlocking member only, the housing has a narrowed portion which keeps the fixation member with its gripping portion forced radially inwards when the unlocking member is in said second rest position, and the first and the second contact member are connected to a body of insulating material so as to be electrically insulated from the housing, the fixation member, and the unlocking member.

The push-in/push-out lampholder according to the invention is of a simple and reliable construction.

The second rest position may be equally far or less far removed from the insertion opening as/than the first rest position. It may be favorable, however, when the second rest position is farther removed from the insertion opening than is the first rest position. When a lamp is used with its lamp cap down in a luminaire with the lampholder, the lamp will project less far into the luminaire in the position in which it can be removed in this embodiment than in the position in which it is retained, for example projecting just from the luminaire. The lamp can then be readily removed from the luminaire in its base-down position also in the case of a luminaire which narrowly encloses the lamp.

The presence of a guide track for the unlocking member and the shape thereof, for example, approximately heart-shaped in embodiments, with the first rest position in the bottom point of the heart shape and the second rest position centrally at the top, means that a separate push must be given twice: once for inserting a lamp cap and once for removing it. The unlocking member is retained in the first rest position by spring force, until the member is moved up along the heart-shaped track under the influence of a pressure exerted by means of the lamp cap. Upon reaching its highest point, the unlocking member must first be released, whereupon spring force in the lampholder presses the unlocking member along the continuation of the first path of the track down over some distance, into the second rest position. Only then can the unlocking member be moved along the second path (back) to the first rest position in that first the lamp cap is pressed against it once more and subsequently the spring force in the lampholder acts on it.

The fixation member and the unlocking member are electrically neutral because the first and the second contact member are electrically insulated from the housing, the fixation member, and the unlocking member. This also brings with it the major advantage that at least the wall of the housing, or the entire housing, but possibly also the lampholder may be entire made from metal, apart from the insulation for the contact members. The result of this is that the lampholder may be of small volume. Another advantage is that current passage through the unlocking member, and thus the risk of corrosion caused by sparks or contact resistances, are avoided, as is heat generation caused by current passage. The contact members may each be connected to an individual body of insulation material or jointly to one such body. The latter has the advantage that the manufacture of the lampholder necessitates less assembling work.

The reliability of the lampholder also benefits from the permanent, non-elastic coupling between the unlocking member and the fixation member which coupling is rigid, for example. The narrowed portion in the housing which forces the fixation member radially inwards so that it engages a lamp cap for locking the latter serves this same purpose.

It is favorable for a wide dimensional tolerance of the lampholder and also of a lamp cap to be accommodated therein when the fixation member is of multiple construction, for example at least two-fold, so that there are at least two gripping portions. A skew position of the lamp in the lampholder is prevented in the case of at least a three-fold construction. In spite of said tolerances, it is certain in the case of a multiple fixation member that the lamp is reliably retained, also when subjected to impacts and/or vibrations.

It is favorable when the, spring force directed towards the insertion opening is supplied by a compression spring, in particular a spring which in its fully compressed state in the lampholder has a force of at least 20N, in particular approximately 30 to approximately 35N, or a number of springs together supplying such a force. A substantially higher compression force would cause the placement and removal of a lamp to be too heavy. The use of the lampholder in a false-ceiling luminaire would also involve the risk of a ceiling section being raised during said placement or removal. In general, the spring is then capable of pushing up an accommodated lamp to outside a luminaire with the lampholder. A compression spring increases the simplicity of the construction.

It is advantageous when such a spring bears on the body of insulating material.

It is favorable for an even pattern of forces in the lampholder when the unlocking member is of multiple construction, for example two-fold, and the lampholder has at least the same number of guide tracks.

The first contact member is preferably recessed into a cavity of the insulator body. The live member cannot be touched with a standard test finger then. It is advantageous for the same reason, if the live lead should inadvertently be connected to the second contact member, when also the second contact member is recessed into a cavity of its own. This also increases the distance from the contact members to any other metal parts present in the lampholder, both creepage and air paths. A lamp cap placed in the lampholder is then capable of screening off the contact members from their surroundings substantially entirely. This renders it possible to have the lampholder carry high voltages as well.

It is favorable for realizing an at least minimum contact force with the lamp cap, for example of 2N, when the contact members are resilient independently of one another.

In a special embodiment, the unlocking member and the fixation member are combined into one unit. This integrated member may then comprise, for example, a radially resilient arm at a free end of which there is, for example, a rod with two free ends which can traverse the guide track with a first free end. The guide track may then have level differences, being farther removed from the axis of the housing in the first rest position than in the second rest position. When the first free end has entered the second rest position, the rod is forced closer towards the axis of the housing than in the first rest position. In this arrangement, the rod may grip with its second free end into the profile of an inserted lamp cap. Alternatively, such an arm may have two projections such as, for example, bulges or pins. This embodiment has the advantage of a further simplification of the construction. This embodiment further has the advantage of a direct coupling of the two functions, and thus a greater reliability.

In a special modification, the integrated members have at least one ball, for example a spherical ball, for example made of synthetic resin or metal, which is capable of traversing the guide track as the unlocking member and of gripping into a profile of a lamp cap as the fixation member. The ball may be enclosed in an inwardly narrowing bore of a cylindrical ball holder, or may alternatively be fastened, for example, to a radially movable, for example resilient arm, or may be held in position by such an arm. This modification has the advantage of a even simpler construction of even greater reliability.

Such an integrated member may be of multiple, for example two-fold, or even better three-fold construction. The arms may be present, for example, at a ring, a flat ring or a cylindrical ring.

In a special embodiment of the lampholder according to the invention, the lampholder has several guide tracks which are interconnected so as to form a continuous circuit which is closed in itself. The unlocking member, which may or may not be of multiple construction and which may or may not be integral with the fixation member, then traverses the entire circuit in succession when a lamp cap is repeatedly inserted and removed. The lamp in that case rotates through 360°. This embodiment has the advantage that a comparatively small axial zone is sufficient for accommodating the guide track.

In an attractive embodiment, the body of insulating material which is connected to the first and second contact members is uncoupled from the fixation member. This embodiment has among its advantages that it renders possible a comparatively wide tolerance on the axial dimensions of the lamp cap to be accommodated. It is rendered possible thereby that the body of insulating material performs a greater axial movement than do the fixation member and the unlocking member during the placement of a lamp if the distance between the base of the lamp cap and the profile thereof is greater than the minimum distance. The result of this is that both the desired contact pressure between the lamp cap contacts and the lampholder contact members and the predetermined optimum engagement between the fixation member and the lamp cap profile are safeguarded. In addition, assembling of the lampholder is simplified.

BRIEF DESCRIPTION OF THE DRAWINGS

Embodiments of the push-in/push-out lampholder according to the invention are shown in the drawing, in which.

DETAILED DESCRIPTION OF THE PREFERRED EMBODIMENTS

Figure 1:
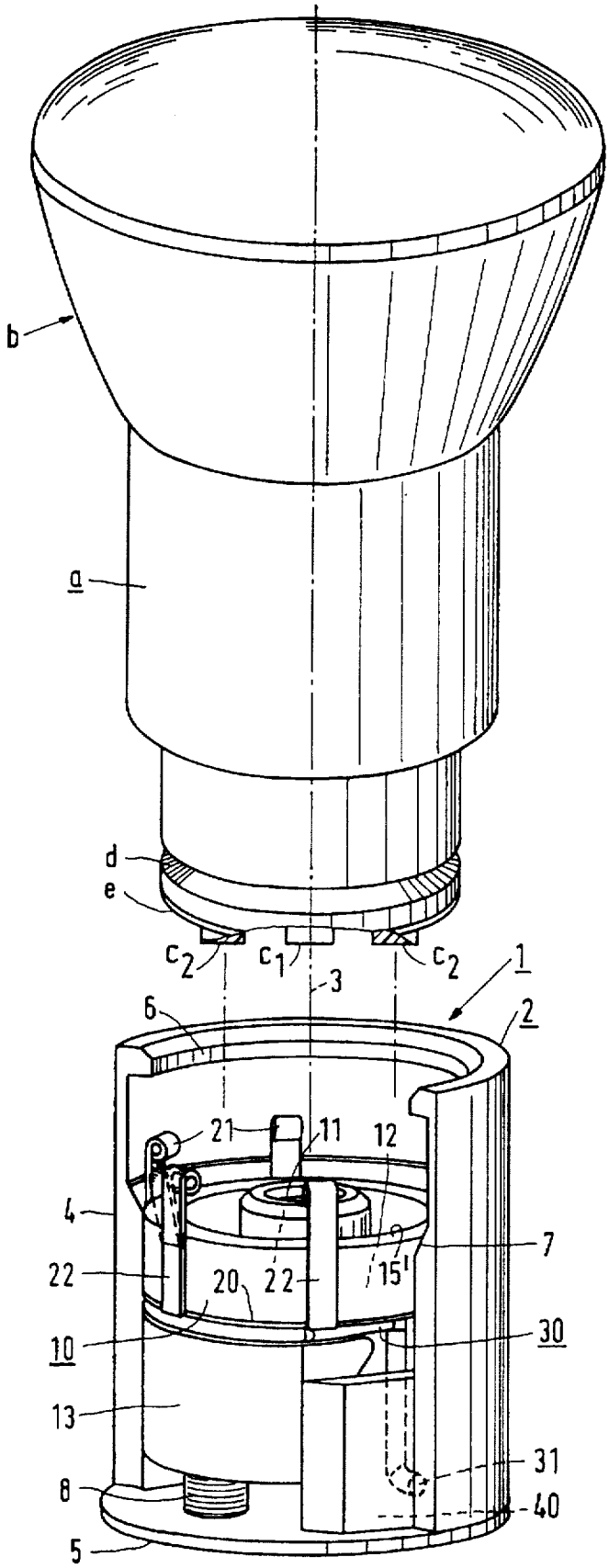
FIG. 1 is a broken-away perspective view of a first embodiment of the lampholder with a mating electric lamp with its lamp cap partly broken away.

In FIG. 1, the push-in/push-out lampholder 1 has a e.g. metal housing 2 with an axis 3, a wall 4 surrounding the axis, a base 5 transverse to the axis 3 and connected to the wall 4, and an insertion opening 6 for a lamp cap (a) of an electric lamp (b) opposite the base 5. A first 11 and a second contact member 12, both axially movable, are present in the housing 2 (see also FIG. 3), facing the insertion opening 6, so as to make contact with contacts ($c_1$, $c_2$) of said lamp cap (a), the first member 11 being centrally positioned and the second 12 being positioned on a circle concentric with the first contact member 11. The second contact member is annular, see FIG. 3. A radially movable fixation member 20 with a gripping portion 21 is present in the housing 2 for gripping with locking action into a profile (d) of the lamp cap (a) and retaining the lamp cap. An unlocking member 30 which is axially movable against a spring force directed towards the insertion opening 6 is present in the housing 2 for releasing the fixation member 20 from the profile (d) of the lamp cap (a). The unlocking member 30 is coupled to the fixation member 20. The Figure shows the lampholder 1 in the position in which a lamp can be held, with the spring 8 in a compressed state. The lamp cap (a) has a base (e).

Figure 2:
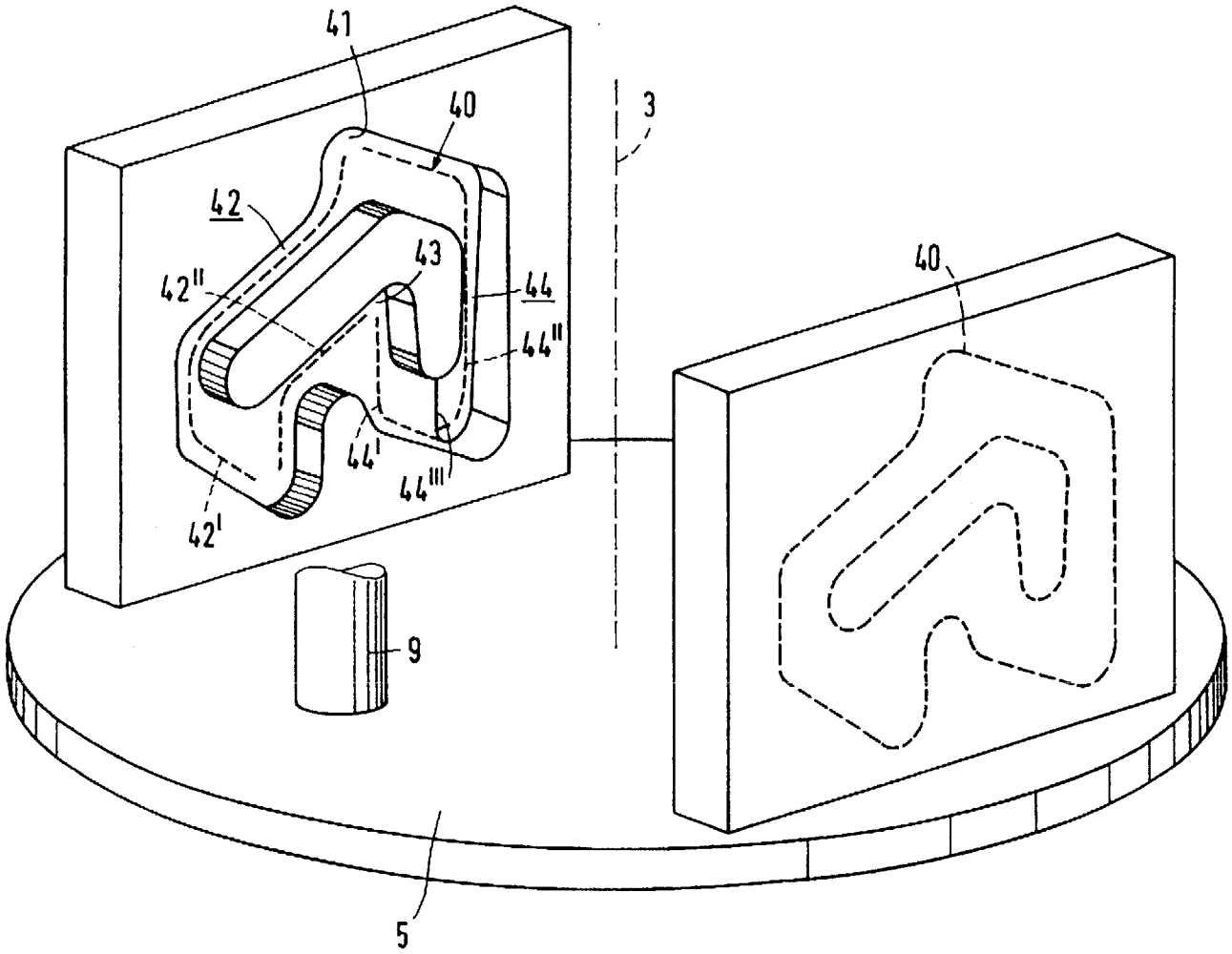
FIG. 2 shows the base of FIG. 1 with a guide track in perspective view.

The lampholder 1 has a guide track 40 for the unlocking member 30, see FIG. 2, with a first rest position 41 which in this Figure is situated comparatively close to the insertion opening 6 and comparatively remote from the base 5, and a first path 42 to a second rest position 43 which in this Figure is farther away from the insertion opening 6 and closer to the base 5. The first path 42 extends initially in a portion 42' to beyond the second rest position 43 in axial direction, approaching the base 5, whereupon it leads back in axial direction in a portion 42" to the second rest position 43, at the same time following a direction transverse to the axis 3.

The portion 42' can be traversed by the unlocking member 30 under the influence of a lamp cap which is being pressed into the lampholder. When the unlocking member 30 has reached the deepest point of the guide track 40, closest to the base, at the end of the portion 42', and the lamp cap is then released, so that no outward pressure is exerted on the lamp cap any more, the spring 8 will press the unlocking member 30 of FIG. 1 upwards, and the latter will slide into the second rest position 43 under the influence of said spring.

The guide track 40 also has a second path 44 starting from the second rest position 43, first moving away axially from the first rest position in a portion 44' and subsequently approaching the first rest position 41 in a portion 44". If the lamp cap is to be removed from the lampholder in the embodiment shown, the lamp cap is pressed deeper into the lampholder than where it was in its operational position. The unlocking member 30 then traverses the portion 44', slipping down a step 44"' during this, behind which the second path 44 is deeper. The unlocking member 30 has then arrived in a location of the guide track 40 again which is close to the base 5, and a continued pressure against the lamp cap has no effect any more. When the external pressure on the lamp cap is removed, the spring 8 will move the unlocking member 30 along the portion 44" of the second path 44 into the first rest position 41. The portion 44" here is initially a rising slope, and subsequently issues at the level of the first rest position 41.

The unlocking member 30 keeps the fixation member 20 in a releasing position in the first rest position 41. The fixation member 20 in this case has the bent shape shown in broken lines in FIG. 1 so that its gripping portion 21, which can enter the groove (d) of the lamp cap (a) for retaining the lamp cap, has moved radially outwards. In the second rest position 43, the unlocking member 30 keeps the fixation member 20 capable of gripping into the lamp cap, in a locking position.

Figure 3:
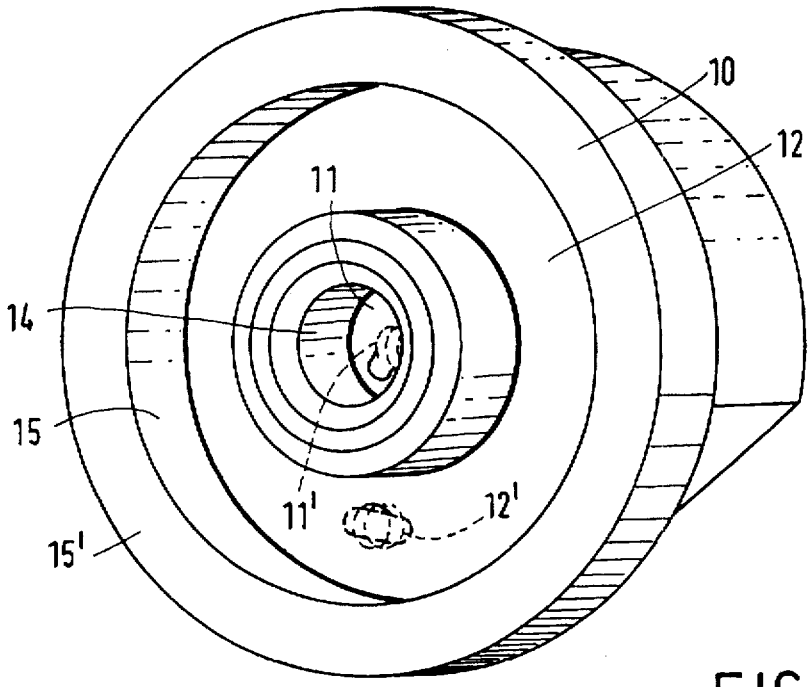
FIG. 3 shows the body of insulating material of FIG. 1 in perspective view.
Figure 4:
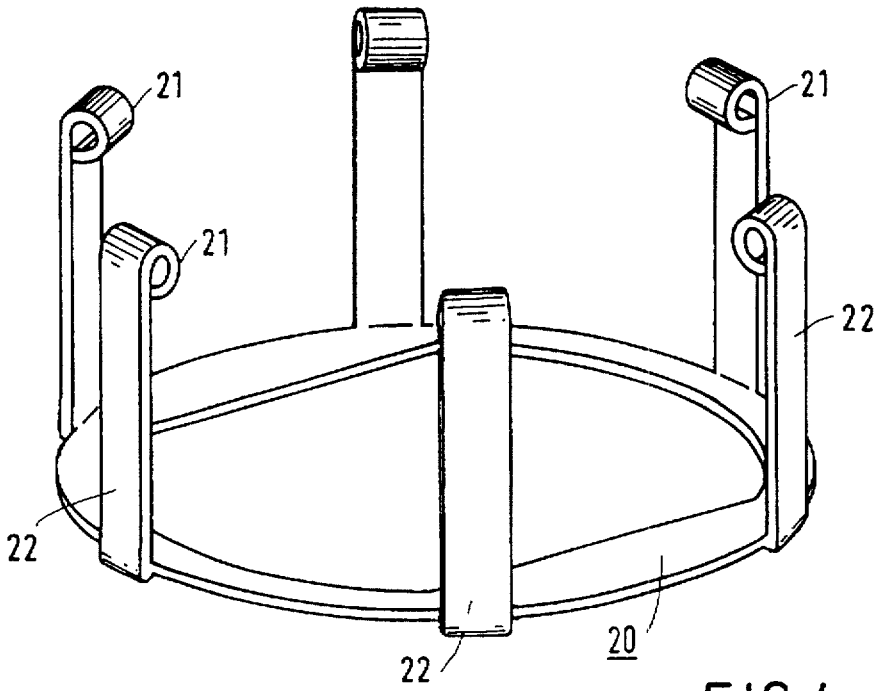
FIG. 4 shows the fixation member of FIG. 1 in perspective view.
Figure 5:
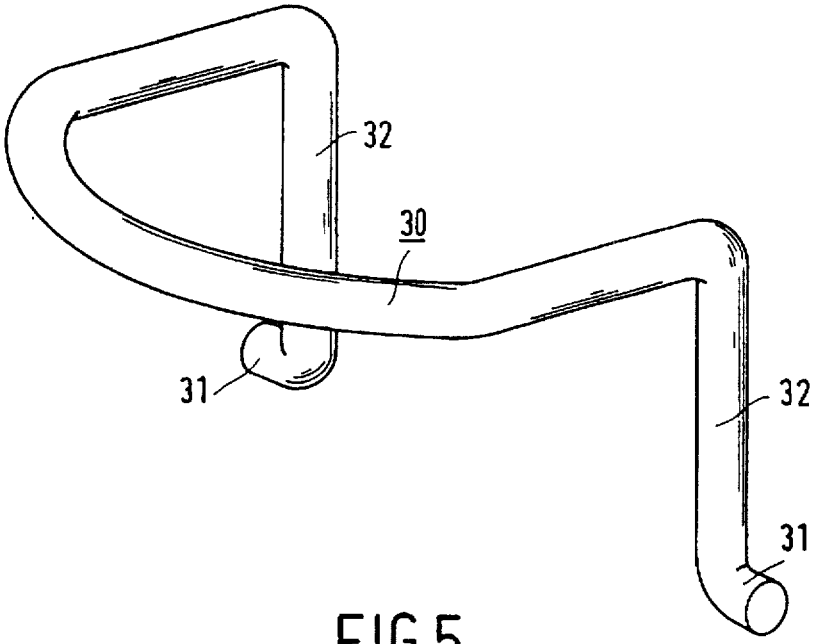
FIG. 5 shows the unlocking member of FIG. 1 in perspective view.

The fixation member 20, see FIGS. 1 and 4, is permanently, non-elastically coupled to the unlocking member 30, see FIGS. 1 and 5, and is axially movable together with the unlocking member 30 only. That is not to say, however, that they cannot have some play in axial direction: mutually, or relative to a body 10 of insulating material, or both. The first 11 and the second contact member 12 are connected to the body 10 of insulating material, ceramic material in FIGS. 1 and 3, i.e. steatite, but alternatively a synthetic resin, for example polyphenylene sulphide if the operating temperature is not more than 220° C., electrically insulated from the housing 2, the fixation member 20 and the unlocking member 30. The body 10 in FIG. 1 is fixedly connected to an insulator body 30, see also FIG. 6, made of synthetic resin in the embodiment shown, with the fixation member 20 and the unlocking member 30 interposed. When the unlocking member 30 performs an axial movement, the fixation member 30 will follow this axial movement.

The housing 2 has a narrowing portion 7 which keeps the fixation member with its gripping portions 21 forced radially inwards when the unlocking member 30 is in said second rest position 43. The narrowing portion 7 in FIG. 1 is at a distance from the insertion opening 6. The narrowing portion forces the fixation member 20 to move its gripping portions 21 inwards when said member is in an axial position remote from the insertion opening 6.

The fixation member in FIG. 1 is made of metal and is of multiple construction, at least three-fold, in this case sixfold, see also FIG. 4 which shows the fixation member 20 in its entirety in the shape which it has in FIG. 1. The gripping portions 21 are present at the free ends of respective elastic arms 22. In a two-fold construction, a lamp could still occupy a tilted position in the lampholder, but this not the case with a three- or more-fold construction when the gripping portions are distributed over the circumference of the member. In addition, the retention security is greater with a three-fold construction than with a two-fold construction.

The spring force is supplied in FIG. 1 by a helically wound compression spring 8 which presses against the body 10 of insulating material, and a second, similar spring which is placed on the base 5 diametrically opposed to the first.

Figure 6:
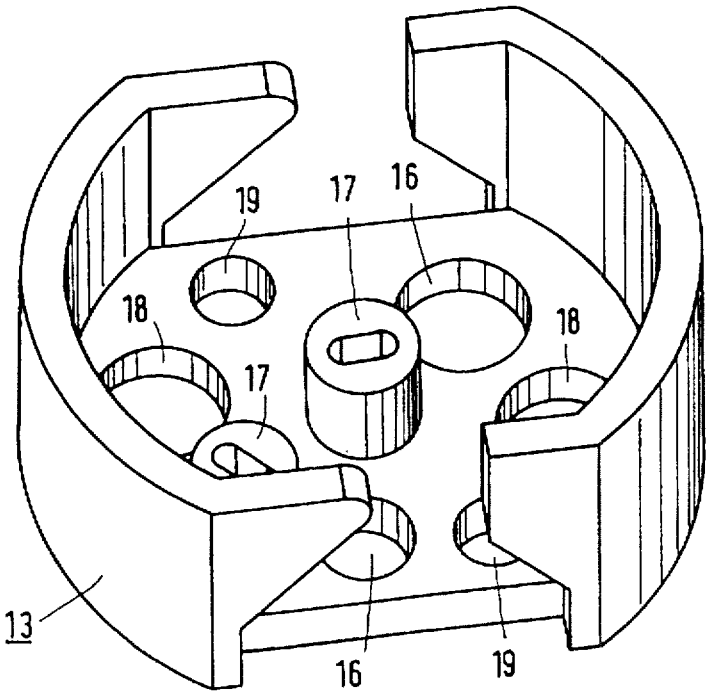
FIG. 6 shows another part from FIG. 1 in perspective view.

The unlocking member 30 in FIG. 1, see FIG. 5, is made of metal and is rigid, and is connected to the body 10 without rotation possibility, cf. FIG. 4 and 6, owing to its shape and to the shape of the body 10 with its parallel plane side surfaces, as is also the case for the fixation member 20, see FIG. 4. The unlocking member 30, see FIG. 5, has a free-end portion 31 which is accommodated in the guide track 40, see FIG. 2. The unlocking member 30 is of multiple construction and has two such free-end portions 31 in the Figure. The lampholder 1 has a separate guide track 40 for each free-end portion 31, see FIG. 1. An even pattern of forces in the lampholder 1 is ensured thereby.

In the embodiment shown, arms 32 comprising the free-end portions 31 are resilient in tangential direction of the housing 2 but also in radial direction thereof. The guide track 40 visible in FIG. 2 is the mirrored image of the guide track on the opposite side so as to provide equal loads on the arms 32. In the second rest position 43, not yet past the step 44''', the arm 42 has a small radial prestress, as is the case in the first rest position 41.

In alternative embodiments, however, the guide tracks may be identical. The unlocking member 30 may then be rotatable relative to the bodies 10 and 13, at least through a small angle, or it may be rotatable together with said bodies. The unlocking member 30 need not be tangentially resilient in that case. Alternatively, the arms 32 may be hinged to the unlocking member 30.

In FIG. 2, the base 5 has a guide member 9 for the spring 8 of FIG. 1.

The body 10 of insulating material shown in FIG. 3 has a cavity 14 into which a first contact member is recessed, and in addition a second, circumferential cavity 15 into which the second contact member is recessed. The two contact members are accordingly supported by one body, but in alternative embodiments they may each be supported by an individual body. It is favorable that the contact members of FIGS. 1 and 3 are axially movable relative to the body 10, for example are resiliently mounted by means of springs below said members, or form part of an elastic body in order to be capable of adaptation to small axial differences in the locations of the contacts ($c_1$, $c_2$) of the lamp cap. A spring 11', 12' is present below each contact member 11, 12 in the Figure.

In FIG. 6, the insulator body 13, made of synthetic resin in the Figure, for example of polyphenylene sulphide, has openings 16 for a thick and for a thin cable which are the live and the neutral lead, respectively, and which are connected to the respective contact members 11, 12 through openings in the body 10, see FIG. 3, which are in correspondence with openings 17. Openings 18 accommodate springs 8 with their guide members 9. Openings 19 facilitate a fastening of the insulator body 13 to the body 10, for example with hollow rivets. The cables may be passed to the exterior through the base 5 or through the wall 4 (FIG. 1).

The narrowing portion 7 of the housing 2 is realized in FIG. 1 by means of a gradient in the wall thickness of the wall 4, but it may alternatively be realized by a separate body, for example a lining.

If the lamp (b) were present with its lamp cap (a) in the holder in FIG. 1, the six gripping portions 21 of the fixation member 20 would grip into the profile (d) with locking action. When the lamp (b) is pressed deeper into the holder, the unlocking member 30 is pressed from its second rest position 43 (FIG. 2), down the step 44''', so that the lamp cannot move any deeper into the holder, usually an axial stroke of a few millimeters. The generated spring pressure in the lampholder 1 then presses the unlocking member 30 into the first rest position 41. An overall axial stroke of, for example, approximately 10 mm may have been made then. The moment the fixation member 20 is no longer forced inwards with its gripping portions 21 by the narrowing portion 7, said portions 21 are released from the profile (d) and the lamp is unlocked. When the lamp (b) is placed with its cap (a) in the holder 1, the lamp cap (a) is inserted as deeply as possible into the holder against the spring pressure, with its base (e) against the rim 15' of the body 10 of insulating material. The contact members 11, 12 are then given a contact pressure of, for example, approximately 3 to 5N against the respective contacts $c_1$, $c_2$, and retain this until the lamp is removed again. The gripping portions 21 of the fixation member 20 are forced radially inwards during this under the influence of the narrowing portion 7 and grip into the profile (d). When the lamp cap cannot be moved any deeper inwards, the unlocking member 30 has arrived with its free-end portion at the smallest possible distance to the base, and the external pressure on the lamp must be removed. The spring pressure built up in the lampholder 1 at that moment subsequently moves the unlocking member 30 into its second rest position 43, where it remains.

The lampholder 1 of FIG. 1 may have a synthetic-resin or ceramic housing 2. It may be necessary in that case to give the housing 2 an outer diameter which is a few, for example 2 to 3 mm greater than if it were made of metal.

In the subsequent Figures, parts corresponding to parts of the previous Figures have the same reference numerals.

Figure 7:
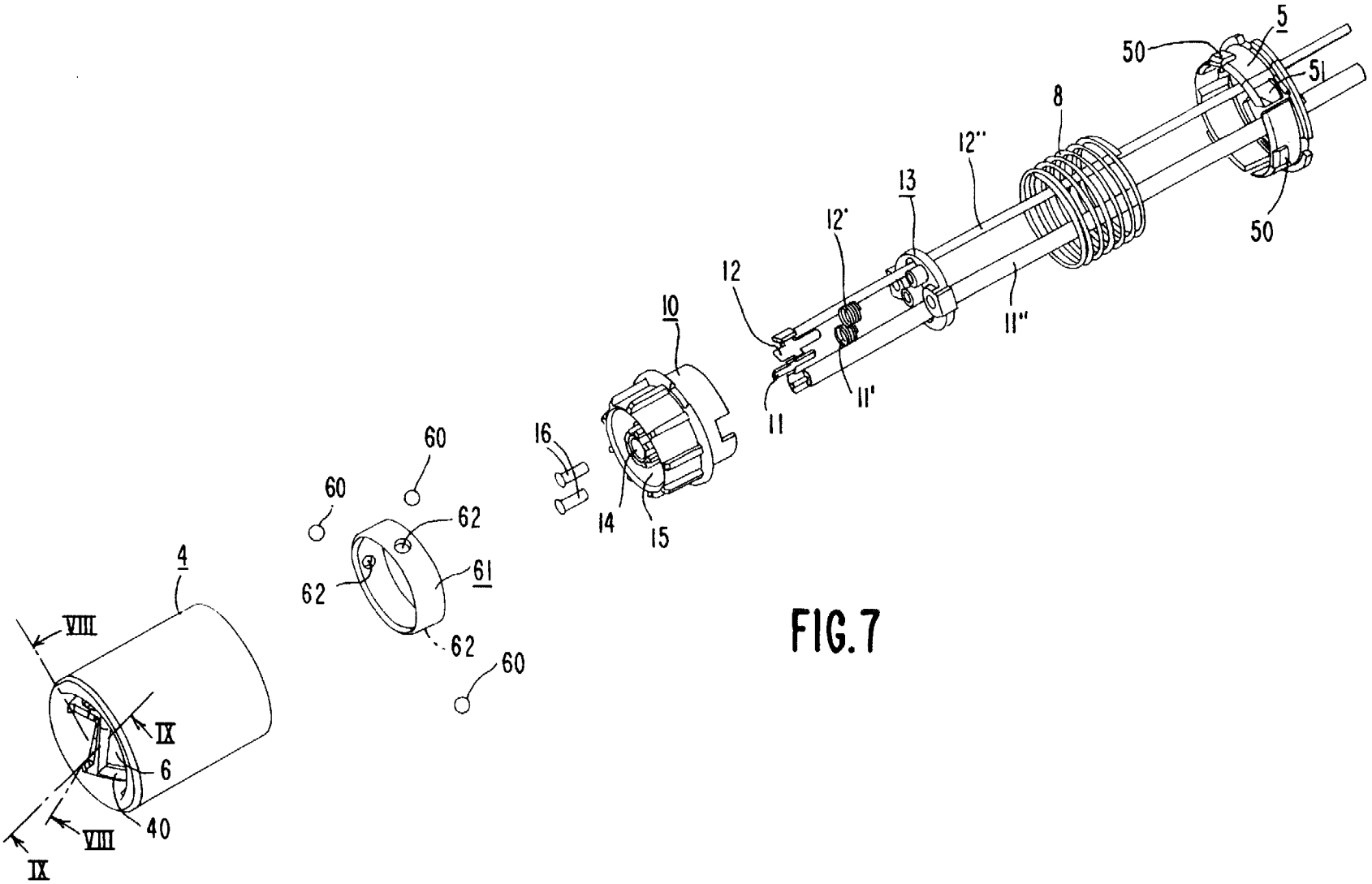
FIG. 7 is an exploded view of an alternative embodiment.

In FIG. 7, a comparatively thick cable 11" is connected as the live lead to the first contact member 11, and a neutral lead cable 12" is connected to the second contact member 12. Hollow rivets 16 connect the body 10 of insulating material to the insulator body 13 so as to constitute a contact block 10, 13 together with the enclosed parts.

Figure 8:
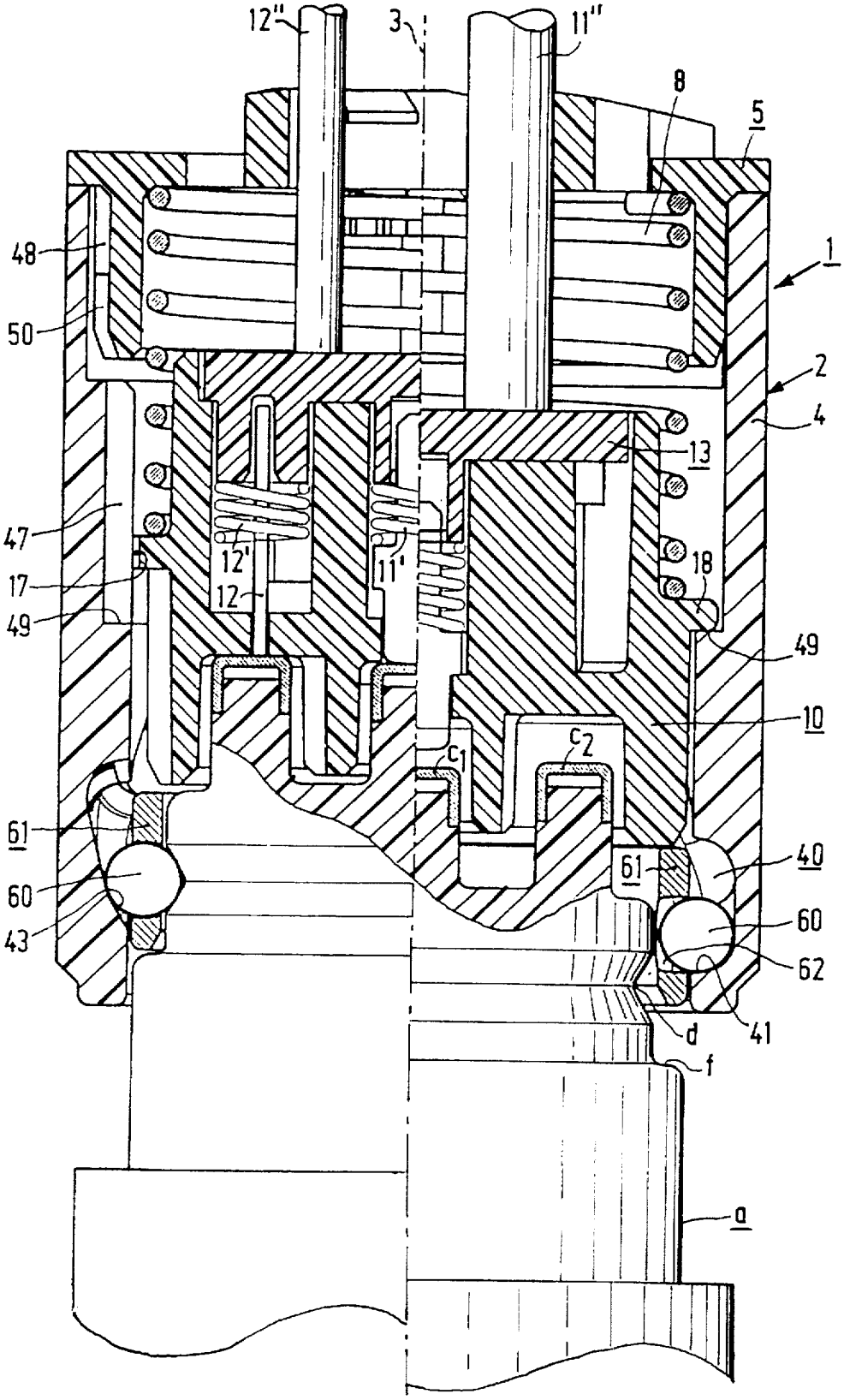
FIG. 8 is a cross-section in two axial planes of the assembled lampholder of FIG. 7 taken on the line VIII—VIII with the lamp cap of an electric lamp retained and yet to be retained.
Figure 9:
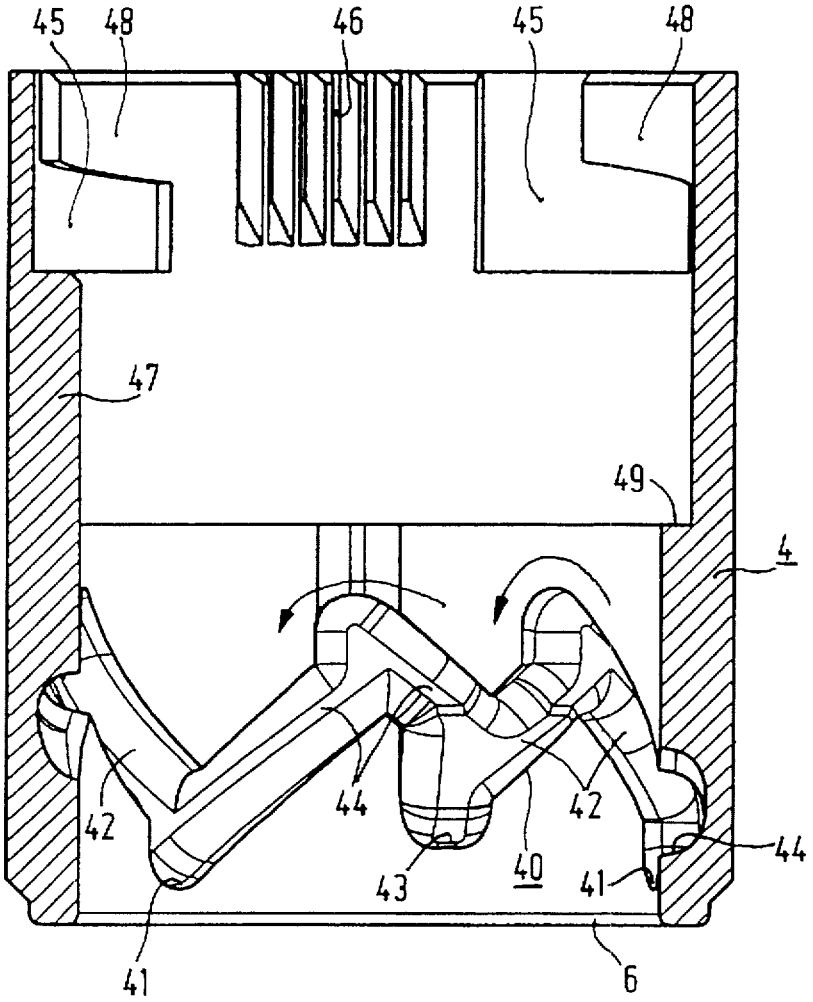
FIG. 9 is an axial sectional view of the housing of FIG. 7 taken on the line IX—IX.

Studs 50 are present at the base 5 for obtaining a bayonet coupling 50, 48, see FIGS. 8 and 9, with the wall 4 of the housing. The base 5 has a resilient tongue 51 for rendering this coupling 50, 48 indetachable in cooperation with grooves 46 in the wall 4, see FIG. 9.

The fixation member 20 and the unlocking member 30 of the embodiment of FIG. 1 are combined into an integrated member 60. The integrated member 60 comprises a ball which is enclosed in an inwardly narrowing bore 62, see also FIG. 8, of a cylindrical ball holder 61.

The lampholder 1 has several guide tracks 40 in the wall 4 which are interconnected so as to form a continuous circuit which is closed in itself, see also Fig. 9.

In FIG. 8 the cross-section on the right shows the situation in which a lamp cap (a) is inserted into the lampholder 1'. The integrated member 60 is of triple construction, cf. FIG. 7, and the balls thereof, made of steel here, are in the first rest position 41. The guide track 40 is comparatively deeply recessed into the wall 4 there. The integrated member 60 is kept in place by the ball holder 61. The balls are capable of penetrating the inwardly narrowing bores 62 in the ball holder 61 only partly. The balls leave the passage through the ball holder 61 free for the lamp cap (a) or clear this passage upon coming into contact with the lamp cap substantially without any force being required for this.

When the lamp cap (a) is inserted deeper into the lampholder 1', it will touch and depress contact members 11, 12 with its first ($c_1$) and second contact ($c_2$), until it also touches the body 10 of the contact block 10, 13. The springs 11', 12' continually provide the desired contact pressure during this. Then the contact block 10, 13 is pressed deeper into the housing. The contact block 10, 13 then becomes clear of the ball holder 61. The contact block 10, 13 is in fact uncoupled from the integrated member 60, and accordingly from the fixation member 20 as shown in FIG. 1 which forms part of the integrated member 60. A slim object could move the contact block 10, 13 to deep inside the housing 1" without the ball holder 61 leaving its position. In the rest position of the lampholder as shown, however, it is useful that the contact block 10, 13 presses against the ball holder 61 under the influence of the spring 8 in order to keep the integrated member 60 fixed in its first rest position 41, ready for accommodating a lamp cap. When the lamp cap (a) is pressed farther inwards, the surface (f) of the lamp cap will touch the ball holder 61 and take it along. When the lamp cap (a) has been pressed inwards as far as the integrated member 60 in the guide track 40 allows, the external pressure on the lamp cap must be reduced to less than the spring pressure. The spring 8 accordingly presses the lamp cap (a) some way back until the integrated member 60 has passed along the continuation of the first path 42, see FIG. 9, and has reached the second rest position 43, where the relevant lamp is ready for operation. The situation shown on the left in FIG. 8 has been reached then.

It is apparent from FIG. 8 that the guide track 40 is recessed less deeply into the wall 4 in the second rest position 43 than in the first rest position 41. The integrated member 60 as a result is forced inwards and grips into the symmetrical profile (d) of the lamp cap (a). The integrated member 60 is then capable of finding its ideal, deepest position in the profile (d) because the contact block 10, 13 is uncoupled from this member 60 and can be pressed deeper into the lampholder by the contacts $c_1$, $c_2$. There is accordingly a distance between the ball holder 61 and the contact block 10, 13 on the left in the Figure, whereas there is no such distance on the right in the Figure. The integrated member 60 and the ball holder 61 have rotated through an angle of 60-x° from the position on the right to the position on the left in the Figure. Although the guide track 40 of FIG. 9 is of three-fold construction, said rotation is less than 60° because the first path 42 is tangentially shorter than the second path 44, which implies a further angular rotation of 60+x° upon a second, separate push against the lamp cap (a).

A comparison of the guide track 40 on the right and on the left in the Figure shows that the decrease in depth of said track in the wall 4 is realized for the major part in the final, substantially axially extending portion of the first path 42 leading to the second rest position 43. The housing 2 in the embodiment drawn has its narrowing portion, indicated with 7 in the embodiment of FIG. 1, to a substantial degree in that location.

To prevent the contact block 10, 13 from joining in the rotation and the cables 11', 12' from becoming entangled, the housing 2 has a rib 47 and the body 10 has a flange 18 with a groove 17 in which said rib can glide so as to form a longitudinal guide 47, 49.

The wall 4 has an abutment 49 for the flange 18 for absorbing the pressure of the spring 8 in the rest position.

It is visible on the left in the Figure that a stud 50 at the base 5 cooperates with a projection 48 at the wall 4, see also FIG. 9, so as to form a bayonet closure 48, 50.

FIG. 9 shows the projections 48 with the L-shaped grooves 45 for the bayonet closure with the base 5, and the grooves 46 which are to make this closure indetachable. The guide track 40 is traversed by the integrated member 60 in the direction of the arrows from a first rest position 41 on the right in the Figure through the portions of the first path 42 into the second rest position 43 shown, and from there through the portions of the second path 44 into the other, first rest position. It can be seen from the Figure that three such guide tracks are connected in series, one track for each ball, so as to form a closed circuit in the wall 4 shown. It is alternatively possible, however, that double this number, or a multiple of this number of guide tracks is present, depending on the dimensions of the balls and the diameter of the lampholder housing. Were the integrated member 60 of double instead of triple construction, two or twice two, or a multiple of two guide tracks could have been connected in series.

In the lampholder 1' shown, the maximum axial stroke of which the combined member 60 is capable is approximately 12 mm, see FIGS. 7 and 8. It is possible to choose the maximum stroke to be greater, if so desired. A lamp having a light emission window which is, for example, convex, may then be easily removed from a luminaire with the lampholder, also if this luminaire encloses the lamp narrowly, while on the other hand it can be accommodated sufficiently deeply in the luminaire in its operational position in order to have a sufficient screening. It is possible for this purpose, for example, for the wall 4 of FIG. 9 to have a greater axial dimension, while the first rest position 41 may be shifted closer to the insertion opening 6 along an axial path from the first rest position as drawn.

We claim:

1. A push-in/push-out lampholder comprising:

a housing having an axis, a wall around said axis, a base transverse to said axis and connected to said wall, and an insertion opening for a lamp cap of an electric lamp opposite said base;

a first and a second axially movable contact member in said housing, facing towards said insertion opening so as to make contact with contacts of said lamp cap, the first being centrally placed and the second being situated on a circle which is concentric with the first contact member;

a radially movable fixation member with a gripping portion in the housing for gripping into a profile of said lamp cap with locking action and retaining the lamp cap;

an unlocking member in the housing which is axially movable against a spring pressure directed towards the insertion opening and which serves to unlock the fixation member from the profile of the lamp cap, which unlocking member is coupled to the fixation member, wherein the lampholder comprises a guide track for the unlocking member with:

(i) a first rest position comparatively close to the insertion opening;

(ii) a first path to a second rest position, which first path extends first in axial direction to beyond the second rest position and subsequently leads to the second rest position;

(iii) a second path extending from the second rest position, initially moving away axially from the first rest position and subsequently approaching the first rest position, in which first rest position the unlocking member keeps the fixation member in an unlocking position, and in which second rest position the unlocking member keeps the fixation member, which is capable of engagement in said lamp cap then, in a locking position, the fixation member is permanently, non-elastically coupled to the unlocking member and is axially movable together with the unlocking member only, the housing has a narrowed portion which keeps the fixation member with its gripping portion forced radially inwards when the unlocking member is in said second rest position, and the first and the second contact member are connected to a body of insulating material so as to be electrically insulated from the housing, the fixation member, and the unlocking member.

2. A push-in/push-out lampholder as claimed in claim 1, wherein the second rest position is farther removed from the insertion opening than is the first rest position.

3. A push-in/push-out lampholder as claimed in claim 2, wherein the fixation member is of multiple construction.

4. A push-in/push-out lampholder as claimed in claim 3, wherein the fixation member is of at least triple construction.

5. A push-in/push-out lampholder as claimed in claim 3, wherein the spring force in the lampholder is supplied by at least one compression spring.

6. A push-in/push-out lampholder as claimed in claim 5, wherein at least the first contact member is recessed into a cavity in the body of insulating material.

7. A push-in/push-out lampholder as claimed in claim 6, wherein the two contact members are recessed into respective cavities of the body.

8. A push-in/push-out lampholder as claimed in claim 7, wherein the contact members are connected to the body with axial resilience independently of one another.

9. A push-in/push-out lampholder as claimed in claim 8, wherein the compression spring presses against the body of insulating material.

10. A push-in/push-out lampholder as claimed in claim 9, wherein the unlocking member is of multiple construction.

11. A push-in/push-out lampholder as claimed in claim 10, wherein the fixation member and the unlocking member are coupled to the body of insulating material.

12. A push-in/push-out lampholder as claimed in claim 10, wherein the fixation member and the unlocking member are combined into an integrated member.

13. A push-in/push-out lampholder as claimed in claim 12, wherein the integrated member comprises a ball which is enclosed in an inwardly narrowing bore of a cylindrical ball holder.

14. A push-in/push-out lampholder as claimed in claim 12, wherein the lampholder comprises several guide tracks which are interconnected so as to form a continuous circuit which is closed in itself.

15. A push-in/push-out lampholder as claimed in claim 14, wherein the body of insulating material connected to the first and the second contact member is uncoupled from the fixation member.

* * * * *